US005431210A

United States Patent [19]

Nelson et al.

[11] Patent Number: 5,431,210

[45] Date of Patent: Jul. 11, 1995

[54] PANEL RETAINERS

[75] Inventors: LeRoy O. Nelson, Minnetonka; Stafford B. Nelson, Chanhassen, both of Minn.

[73] Assignee: Media/Graphics, Inc., Minneapolis, Minn.

[21] Appl. No.: 194,251

[22] Filed: Feb. 10, 1994

[51] Int. Cl.[6] ..... A47G 5/00

[52] U.S. Cl. ..... 160/135; 211/182

[58] Field of Search ..... 211/182; 160/135, 351; 403/305, 306, 314, 361, 294, 311, 292, 298

[56] References Cited

U.S. PATENT DOCUMENTS

| | | | |
|---|---|---|---|
| 470,514 | 3/1892 | Simpson | 403/292 X |
| 1,797,691 | 3/1931 | Merrill | 403/292 X |
| 3,011,524 | 12/1961 | Seils | 403/314 X |
| 3,596,701 | 8/1971 | Conan | 160/135 |
| 4,320,984 | 3/1982 | Mayer et al. | 403/292 |
| 4,653,563 | 3/1987 | Bannister | 160/135 |
| 4,825,930 | 5/1989 | Lindberg et al. | 160/135 |
| 4,896,992 | 1/1990 | Muhlethaler | 211/182 X |
| 5,022,777 | 6/1991 | Kolvites | 403/292 X |
| 5,115,855 | 5/1992 | Lindblom et al. | 160/135 |
| 5,131,448 | 7/1992 | Miller | 160/135 |

*Primary Examiner*—Blair M. Johnson

*Attorney, Agent, or Firm*—Westman, Champlin & Kelly

[57] ABSTRACT

A panel retainer for retaining panels in end to end position, with edge post members aligned, comprising end portions of the edge post members having bores for receiving a retainer pin and having bosses to engage a properly sized pin inserted into the end portion. A retainer pin has a larger diameter portion which is frictionally engaged by bosses in one edge post member stopped in a location with a smaller diameter portion extending out of the edge post member. The second edge post member slideably receives the smaller diameter portion for making an assembly. The smaller diameter section clearing the bosses and the stop in the second edge post member so the edge post member abut with the pin aligning and retaining the first and second posts from transverse movement.

8 Claims, 4 Drawing Sheets

16
14
12
40

PANEL RETAINERS

BACKGROUND OF THE INVENTION

The present invention relates to a pin retainer for holding panel sections in an assembled condition, which permits use of identical corner posts for the panels for receiving the pin for versatility in configuring panel assemblies.

Assemblies of panels are used for a wide variety of purposes, particularly for displays, and the panels are usually in sections that can be conveniently handled but which must fit together in various configurations to accommodate the needs of the user. At the present time, panels which have edge posts with a panel wall supported by the posts, as well as top and bottom structural members, are held assembled on top of another panel using pins which are retained in receptacles in the aligning ends of the edge posts. However, a pin that has a uniform diameter throughout is utilized in the prior art, and this means that in order to permit the pin to slip into an opening in the end posts on one of the panels, while having the pin retained in the posts of the mating panel, the receptacles in the aligning end posts have to be configured differently.

The pins are usually press fitted into end receptacles of one set of posts using dimples that engage the side walls of the pin, and a pin stop is provided for preventing the press fitted pin from sliding inwardly into the post opening (the end posts are usually extrusions) more than a desired amount. The free end of the pins held in one panel have to slip freely into the receptacles in the ends of the posts of a mating panel, so with a uniform diameter pin the mating panel posts cannot have dimples or stops or the free end of the pin would not slip in. This means that top and bottom panels are not interchangeable, and that the panel that is holding the pins has end posts that differ in configuration from the end posts of panels into which the free ends if the pins slip.

SUMMARY OF THE INVENTION

The present invention relates to a panel retainer which permits utilizing panels that have upright side edge post members along lateral edges which are identically constructed on two panels which will assemble or stack together. The panel retainer of the present invention comprises a pin that has different cross sectional sizes at its opposite end portions, and which is retained and held securely in a receptacle at an end of a post member of one of the panels. Each pin is held with a protruding smaller diameter free end that will slide into an identical opening or receptacle in the end of an aligning post member of another panel.

The edge post members are preferably extrusions which have continuous internal openings throughout their lengths, and the pin retainers specifically as shown are friction fit dimples or similar protrusions that will grip the larger cross sectional end of the pin, but will clear the smaller cross sectional area, free end portion of the pin. A pin stop is used to prevent the larger cross sectional pin portion from sliding too far into the edge post member opening. The pin stop is spaced inwardly from the end surface sufficiently so that the smaller cross sectional area, free end portion of the pin will not be stopped when it slides into the edge post member of a mating panel. The edge post members thus will rest end to end against each other under gravity when the panels are stacked vertically.

The pin is easily manufactured, but permits the same edge post member to be used for all panels manufactured so that the panels can be mated together in any desired configuration without concern about having to select panels of proper configuration to form stacked pairs of panels.

The panel assembly can be made with two or three panels stacked vertically, and great versatility can be obtained in the way that the panel retainer pins are positioned with respect to the panels on which they are supported and into which they fit.

DETAILED DESCRIPTION OF THE PREFERRED EMBODIMENTS

Figure 1:
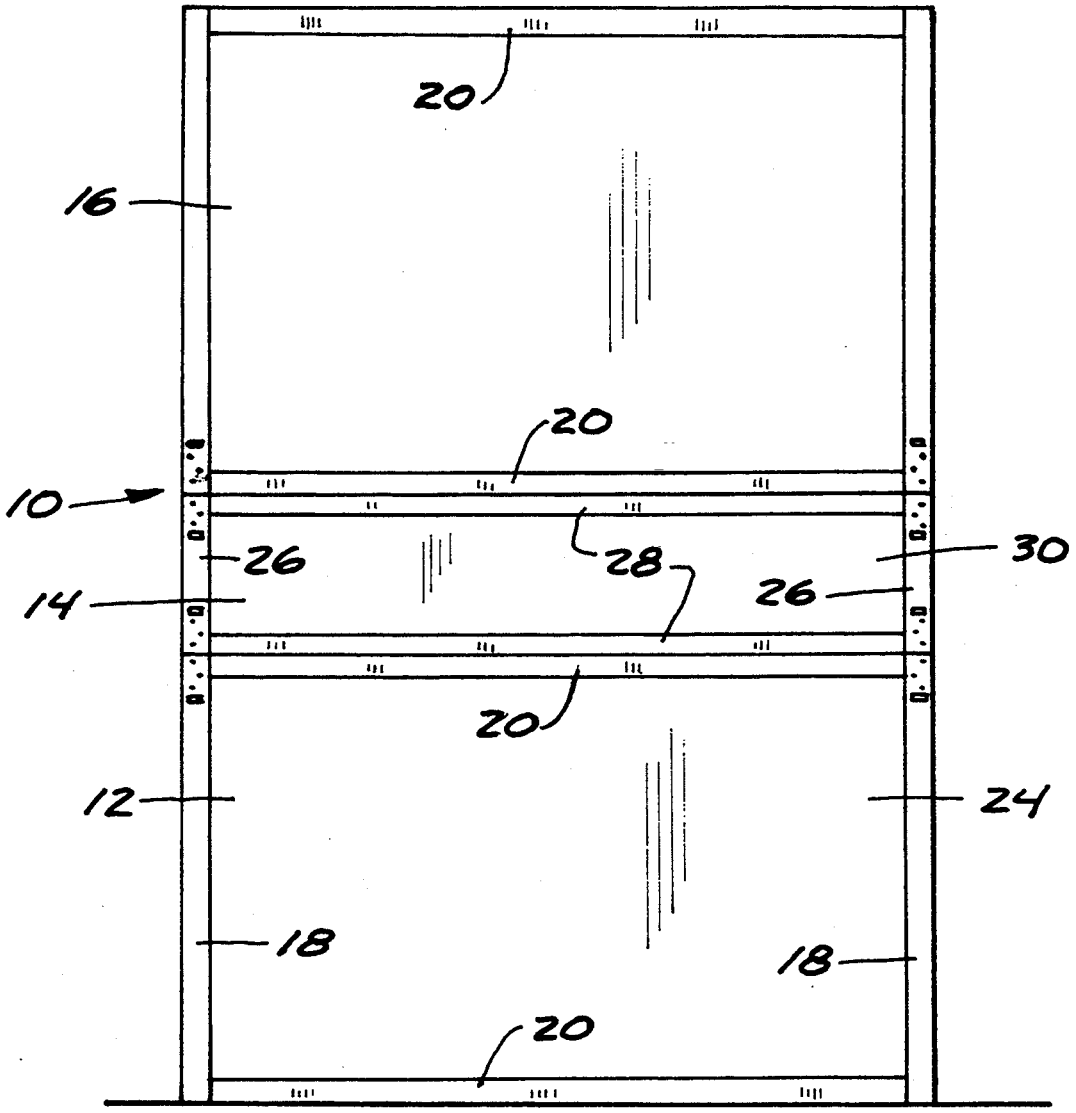
FIG. 1 is a side elevational view of the typical panel assembly utilizing retainer pins made according to the present invention.

FIG. 1 illustrates generally a panel assembly 10 that is in erected condition, insofar as vertical placement is concerned. The panel assemblies can be joined end to end laterally with additional panel assemblies, to create a display system. As shown, there are generally upright, vertical panels stacked one on top of the other. These include a bottom panel 12, a center panel 14, and an upper panel 16. Each of the panels is constructed in the same manner, with panels 12 and 16 being identical in construction and size and having spaced upright edge post members 18, top and bottom cross members 20 fixed to the edge post member 18, and a solid panel wall member 24. The assemblies can be used for supporting displays or can be merely used as room or space dividers.

The center panel 14 is constructed to have upright edge post members 26, along its opposite side edges, and top and bottom cross members 28 fixed to the edge post members. Center panel 14 has a solid wall 30 held by the top, bottom and edge members.

The panels 12, 14, and 16 are retained in their stacked, assembled relationship with a retainer system that permits a wide variety with different configurations. The retainer members permit ease of panel assembly and interchangeability.

Figure 3:
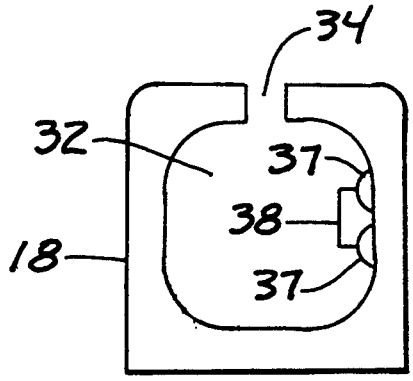
FIG. 3 is a top plan view of a panel edge post member made according to the present invention.

As shown, and preferably, each of the edge post members 18, and post members 26 are extrusions that are shown in cross section in FIG. 3. The post members 18 are shown, but it is to be understood that the edge post members 26 are identical in cross section but have a different length from post members 18. The extrusions have a generally square periphery and have an interior bore opening 32, which is a full length longitudinally extending bore. A slot 34 is provided along one wall thereof and extends for the length of each respective post member. The bore or opening 32 has a desired transverse dimensions with rounded corners.

Figure 2:
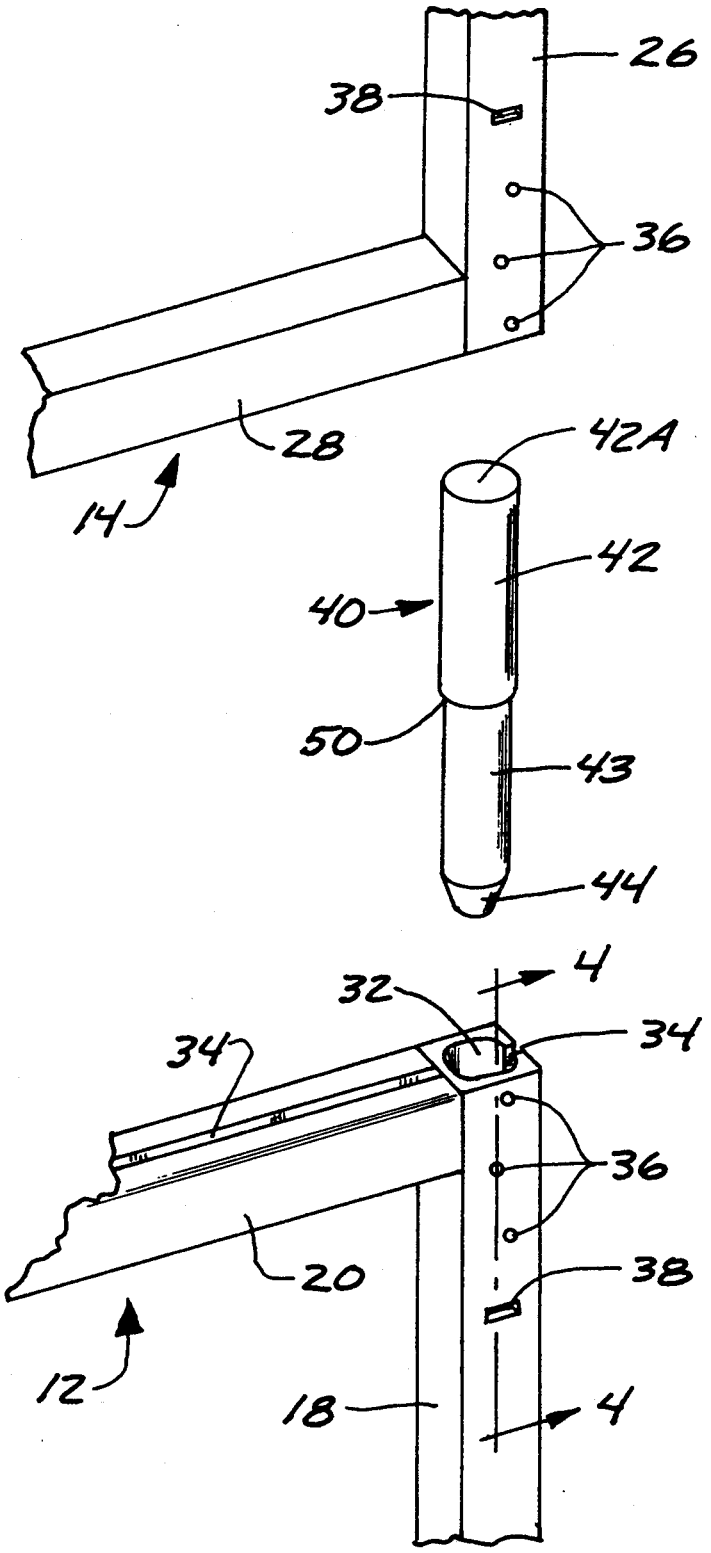
FIG. 2 is a perspective exploded view of mating corners of a pair of panels illustrating a panel retainer pin.

Near the ends of the extrusions forming post members, one or more (preferably at least 3) dimples 36 are formed after extrusion by partial punching into the extension wall. The dimples will countersink into the interior bore of the extrusion to form internal bosses 37. The exterior views of the dimples are shown in FIG. 2 as well. The dimples 36 are spaced in longitudinal direction and can be offset laterally as shown.

Additional, a pin stop 38 is provided in each post member. The pin stop 38 is a tab formed by punching to slit the post wall along three sides of a tab and then bending the tab inwardly into the bore 32. The pin stop 38 is spaced inwardly from each end surface of the respective post member a desired amount.

The panel retainer comprises a special pin 40, which as shown is cylindrical in cross section, and which has a first large diameter portion 42 and a second smaller diameter portion 43 at an opposite end thereof. The smaller diameter portion 43 has a tapered end 44 to permit ease of insertion into a bore at the end of an edge post member. The large diameter portion 42 is slightly shorter than the small diameter portion 43 from the start of tapered end 44 to a shoulder 50 formed at the junction of portions 42 and 43.

Figure 4:
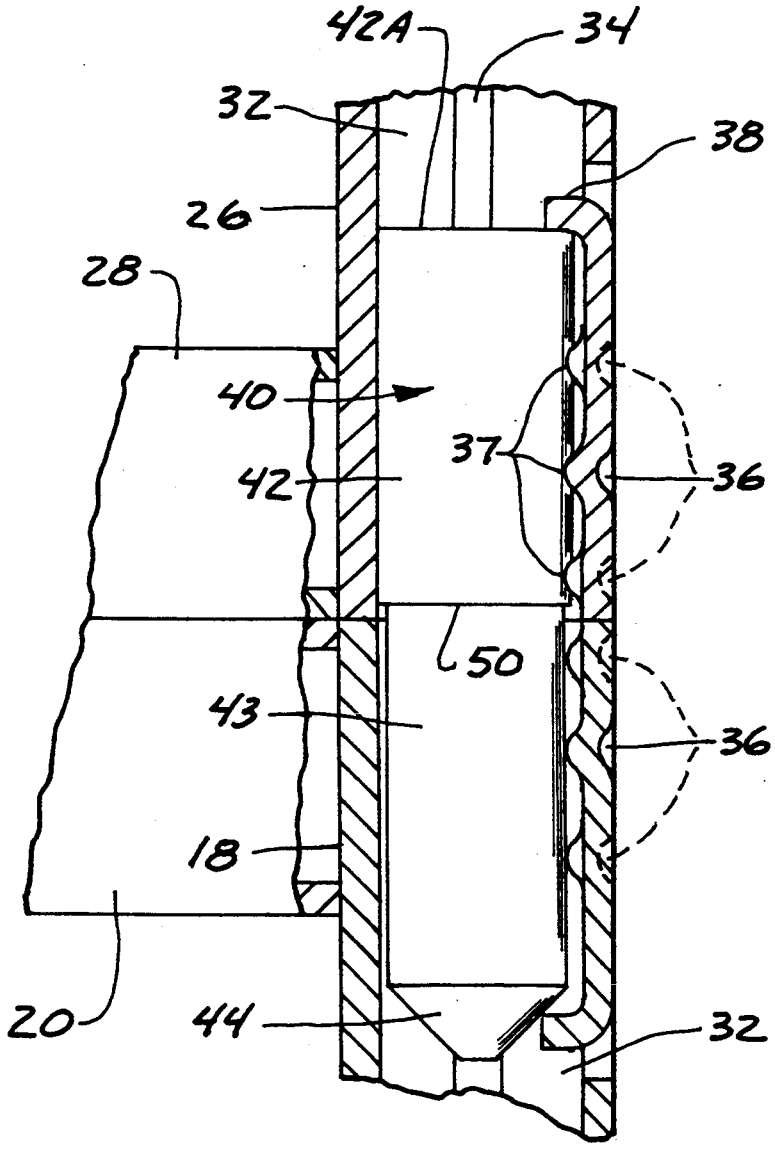
FIG. 4 is a sectional view taken as on line 4—4 in FIG. 2 with the panels assembled.

The diameter of larger diameter portion 42 is substantially equal to the lateral dimensions of the bore or opening 32 forming a pin receptacle adjacent the end of each of the edge post members. When the pin 40 is pressed into place in a post member, the surface of the larger diameter portion 42 will be engaged by the bosses 37 formed by dimples 36, as shown in FIG. 4, and will be retained by frictional holding in the receptacle formed in the end of one of that post member. As shown in FIG. 4, the pin 40 is retained in one of the edge post members 26. The pin stop 38 is provided to engage the end surface 42A of the large diameter portion of the pin 40 to prevent the pin 40 from being slid into the respective edge post member more than a desired amount, and to leave a free end portion, which is the majority of Smaller diameter portion 43, extending from the post member in which the pin 40 is retained.

The small diameter pin portion 43 is selected to slideably fit into a selected end receptacle of any one of the edge post members, such as that shown at 18 in FIG. 4. The portion 43 will clear the bosses 37 formed by dimples 36 that are provided on the interior of that edge post member. This clearance is sufficient so that the pin portion 43 will slide in and out easily. It is a close sliding fit and not loose. The pin portion 43 is thus moved by the bosses toward one lateral side of bore 32 of the particular edge post member into which it slides.

The junction between the large diameter pin portion 42 and the small diameter pin portion 43 defines shoulder 50, and shoulder 50 is positioned in relation to the overall pin length, and in particular, in relation to the distance from the end surface 42A to the shoulder 50, such that when the end surface 42A engages the pin stop 38, the shoulder 50 will be recessed slightly into the edge post member in which it is inserted. This will leave a substantial length of the small diameter portion 43 extending out from the edge post member in which the large diameter portion 42 is placed. The panels can be assembled merely by slipping the small diameter pin portion 43 of the panel retainer pin into the bore or receptacle of an edge post member with which the panel holding pins is to be mated. This is illustrated in FIG. 4, where it can be seen that the pin portion 43 illustrated slips into the bore 42 of the edge post member 18 of the lower panel 12.

The retainer pins 40 can be pulled out the edge post members in which they are retained, because of the friction fit between the bosses 37 and the side surfaces of the large diameter pin portion 42, and the pins can then be inverted, or placed into other edge post members. In the assembly, the tapered end 44 insures that the pin will easily be guided into place into the bore accessed from the ends of the edge post members. The taper also insures that there will be clearance with the pin stop in the edge member into which the small diameter pin portion 43 is placed. This assures that the ends of the edge post members, and the side surfaces of the cross members will mate together tightly and closely for use.

Figures 5A, 5B, 5C, 5D, 5E:
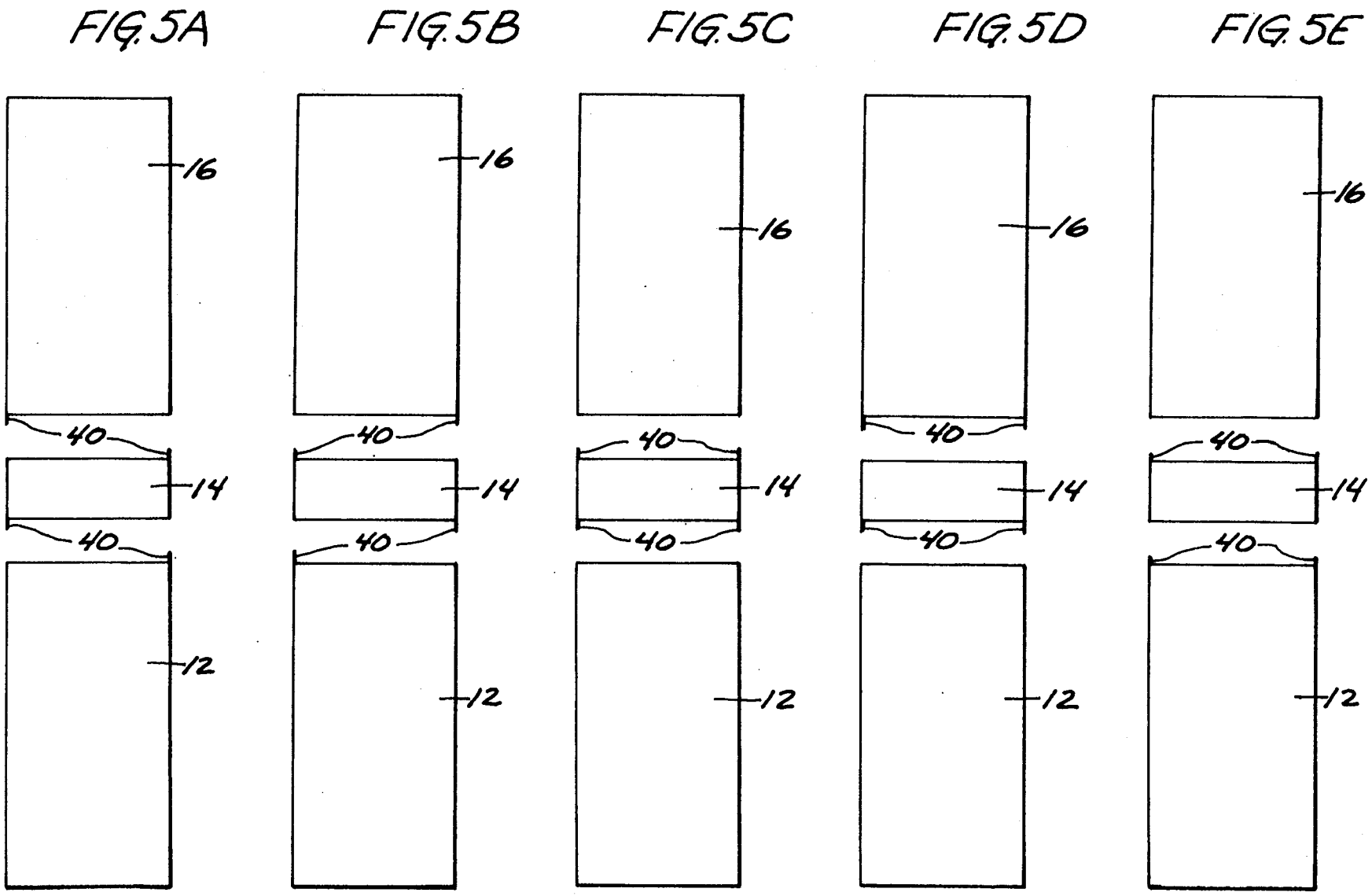
FIGS. 5A, 5B, 5C, 5D, and 5E are schematic illustrative showings of the placement of panel retainer pins in panel edge post members for convenience of assembly.

FIG. 5A shows panels 12, 14, and 16 in exploded position with retainer pins 40 mounted so that one of the pins is in the lower panel 12 on one edge post member, and the outwardly extending small diameter portion will slide up into the intermediate panel 14, while the upper one 16 of the large panels has a retainer pin 40 at the opposite edge and corner. The intermediate section 14 then has two pins facing in opposite directions on the opposite sides to permit ease of assembly.

FIG. 5C shows a different version that is essentially the mirror image of that shown in 5A.

FIG. **5*c* illustrates a system wherein the retainer pins 40 are on the intermediate panel 14, held in the four ends of the edge post members, so that the intermediate panel 14 can be placed on the lower panel 12 with the small diameter pin portion in the upper end bores of that panels edge post member, and then the upper panel 16 placed directly on the small diameter portion 43 of pins 40 on the upper side of the intermediate panel 14**.

FIG. 5D illustrates the pins 40 in a further configuration, with the lower panel 12 not having any pins 40 in place, while the middle panel 14 has a retainer pin 40 at the lower ends of the edge post members, and the upper panel 16 has pins 40 at the lower ends of its edge post members. The panels can be assembled in sequence.

FIG. 5E shows the inversion of FIG. 5D, with the pins 40 held in place on the upper ends of the edge post members of the lower panel 12, and on the upper ends of the edge post members of the center panel 14. Panel 16 does not have any retainer pins 40 held in place, but is made to receive the smaller diameter portion of the pins in panel 14.

The pins may be made of suitable plastic that is reasonably hard and which will not loosen in the regions of bosses 37 over time. The pins can be made quickly and at low cost, and since the panels have identical post end portions cost and inventory of parts and panels is simplified.

Although the present invention has been described with reference to preferred embodiments, workers skilled in the art will recognize that changes may be made in form and detail without departing from the spirit and scope of the invention.

What is claimed is:

1. A panel assembly comprising at least two panels, each having edge post members along edges thereof, wherein the panels are to be mounted with the edge post members in an end to end relation, the edge post members having ends and end openings that face each other when mounted, each of the edge post members having identical pin retainer and pin stops formed therein adjacent their respective ends comprising at least one friction causing boss to engage a pin placed in the bore a desired amount from the respective end of the edge post members, and a pin stop protruding into the bore of each of the edge post members, each of the pin stops being positioned at a substantially identical distance from the respective ends of the edge post members, and a pin for mounting in the bores of the edge post members, said pin having a first portion of cross sectional area such that it frictionally engages a boss in a first edge post member and being stopped against the pin stop when inserted into the bore of such edge post member, said pin having a second smaller diameter portion protruding from the end of such edge post member a desired amount when stopped by the pin stop, the smaller diameter portion of the pin being of size to clear the boss in a second aligning edge post member and being spaced from the pin stop in the second of the edge post members when the first and second edge post members abut end to end.

2. The panel assembly of claim 1 wherein the first portion of the pin has a length selected in relation to the positioning of the pin stop from an end surface of the respective edge post member so that the length of the second pin portion protruding from the first edge post member is less than the distance from the end of such edge post member to the pin stop.

3. The panel assembly of claim 2 wherein the first and second portions of the pin join along a shoulder surface, and wherein the pin stop is selected such that the shoulder surface is recessed into the first edge post member when an end of the first portion of the pin engages the pin stop.

4. A panel assembly combination that is removably retained in end to end relationship comprising a first panel having first and second edge posts; a second panel having first and second edge posts, the first and second edge posts of the first and second panels aligning and abutting when assembled; each of the edge posts having an end portion forming a bore, a plurality of bosses protruding into each bore, and a stop member positioned inwardly from an end of the respective edge post a selected amount, which stop member is farther inwardly than the bosses of that bore, a pin for holding aligning edge posts of the first and second panels in aligned relationship, the pin having a first pin portion, which when inserted into a bore of an end portion of an edge post, is frictionally engaged by the bosses in that bore, and when an end of the pin first pin portion inserted into the bore of the edge post is engaging the stop member, the pin having a second portion which protrudes from such edge post, the second portion of the pin having a diameter such that it will clear the bosses when slid into the end bore of an aligning edge post, and having a length such that it clears the stop member in the bore of the aligning edge post when two edge posts abut in end to end relationship.

5. The combination of claim 4, wherein the second portion of the pin has a beveled end section for entering the bore of the aligning edge post.

6. The assembly of claim 5, wherein the end portions of the edge posts of each of the panels are provided with identically positioned bosses and stops protruding into the respective bores.

7. For use in a panel assembly having first and second panels each with a post aligned with a post of the other panel in end to end relation, the posts having bores that face and align with each other at adjacent ends, and at least one separate boss protruding into each of the bores respectively, the improvement comprising a retainer pin for holding the posts in alignment, said retainer pin having a first portion of cross sectional area such that it frictionally engages a boss in the bore of the post of the first panel in which it is inserted, said retainer pin having a second smaller diameter portion of size to clear the boss in the bore of the aligning post of the second panel, and the retainer pin portions each being of length to provide lateral guidance for the aligning posts of the first and second panels.

8. The assembly of claim 7 wherein the first portion of the retainer pin has a length slightly shorter than the second portion of the retainer pin.

* * * * *